US007155784B1

(12) United States Patent
DeGroot

(10) Patent No.: US 7,155,784 B1
(45) Date of Patent: Jan. 2, 2007

(54) DEVICE FOR SECURING A TROUSER

(76) Inventor: James DeGroot, 20301 Hamilton Pool Rd., Dripping Spring, TX (US) 78602

( * ) Notice: Subject to any disclaimer, the term of this patent is extended or adjusted under 35 U.S.C. 154(b) by 10 days.

(21) Appl. No.: 10/799,276

(22) Filed: Mar. 12, 2004

Related U.S. Application Data

(60) Provisional application No. 60/456,259, filed on Mar. 20, 2003.

(51) Int. Cl.
*A44B 21/00* (2006.01)

(52) U.S. Cl. ..... 24/578.1; 24/528

(58) Field of Classification Search ..... 24/578.1, 24/68 R, 578.15, 68 J, 370, 335, 336, 372, 24/527, 528, DIG. 33, DIG. 34; 2/338, 336, 2/321, 322; 450/86
See application file for complete search history.

(56) References Cited

U.S. PATENT DOCUMENTS 573,685 A * 12/1896 Munro ..... 24/528
2,465,787 A * 3/1949 Bliek ..... 24/66.2
4,003,227 A * 1/1977 Casey ..... 70/14
4,800,594 A * 1/1989 Young ..... 2/237
5,566,397 A * 10/1996 Scott ..... 2/338

* cited by examiner

*Primary Examiner*—James R. Brittain
(74) *Attorney, Agent, or Firm*—Kenneth L Tolar

(57) ABSTRACT

A uniquely designed device for retaining a trouser on a wearer includes a base plate having inner and outer pairs of geared channels extending from one side to the other. A belt loop clasp extends from each side of the base plate. Each clasp includes a hook portion with a pair of arms extending therefrom each of which is slidably received within a designated channel. Each arm includes teeth thereon for interlocking with the geared surface within its corresponding channel. Each of the hooks are secured about a trouser belt loop and the arms are pressed into the base plate until the trouser waist band is sufficiently tight.

4 Claims, 2 Drawing Sheets

DEVICE FOR SECURING A TROUSER

CROSS REFERENCE TO RELATED APPLICATIONS

According to U.S.C. § 119(e), this application is entitled to the benefit of provisional application No. 60/456,259 filed on Mar. 20, 2003.

BACKGROUND OF THE INVENTION

1. Technical Field of the Invention

The present invention relates to a device for securing a trouser about a wearer's waist.

2. Description of the Prior Art

Trouser wearers typically use a belt to suspended the trouser at a select height near the waistline. However, belts are easily lost, misplaced or broken. In such event, the wearer may suddenly be without a means for suspending the trouser, possibly rendering it unwearable. Furthermore, some people for a variety of reasons do not like the appearance or other characteristics of belts but have no other method of suspending the trouser.

Accordingly, there is currently a need for a device that provides a desirable alternative to a conventional belt. The present invention satisfies this need by providing a uniquely designed, easily operable device for securing or tightening a trouser about a wearer's waist thereby eliminating the need for a belt. The compactness and portability of the device allows it be easily stored and transported; accordingly, if a belt is being used and is misplaced or broken, the device can be easily substituted therefor.

SUMMARY OF THE INVENTION

The present invention relates to a device for securing a trouser to a wearer. The device comprises a base plate having an upper surface and a lower surface. Within the base plate are a pair of inner channels and a pair of outer channels, each defined by a pair of spaced walls. Longitudinally extending along one of the walls of each channel is a geared surface. The device also includes a pair of belt loop clasps, each including a hook portion with a pair of spaced arms integrally extending therefrom. Each arm includes a plurality of teeth disposed along the length thereof for interlocking with the geared surface within a designated channel. A first clasp extends from a first side of the base plate with each arm slidably received within one of the inner channels while the other clasp extends from the opposing side of the base plate with each arm likewise slidably received within one of the outer channels. The teeth on each arm interlock with the geared surface of the channel thereby locking each clasp in a select position.

To use the above described device, a user extends each clasp a predetermined distance from the base plate and secures each hook portion around a desired belt loop. The user then simply presses each clasp into the base plate as far as possible or until the trouser waist band is sufficiently tight. To remove the device from the trouser, a user compresses a pair of arms on either or both of the clasps to disengage the interlocking surfaces allowing the clasp to be extended until the belt loops are released.

It is therefore an object of the present invention to provide a device for tightening a trouser that is unique and easy to operate.

It is another object of the present invention to provide a device for retaining a trouser that eliminates the need for a belt.

Other objects, features, and advantages of the present invention will become readily apparent from the following detailed description of the preferred embodiment when considered with the attached drawings and the appended claims.

DESCRIPTION OF THE PREFERRED EMBODIMENT

Figure 1:
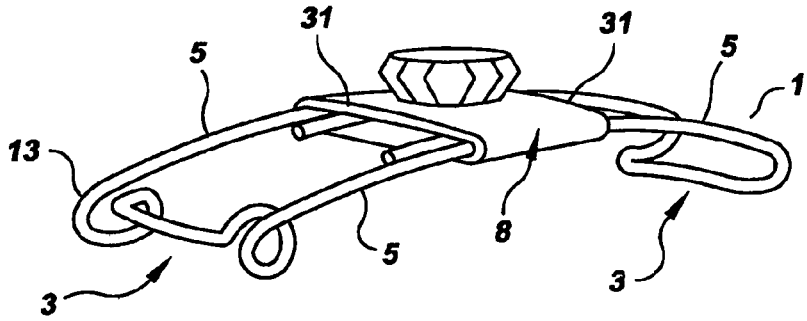
FIG. 1 is a perspective view of the device.
Figure 2:
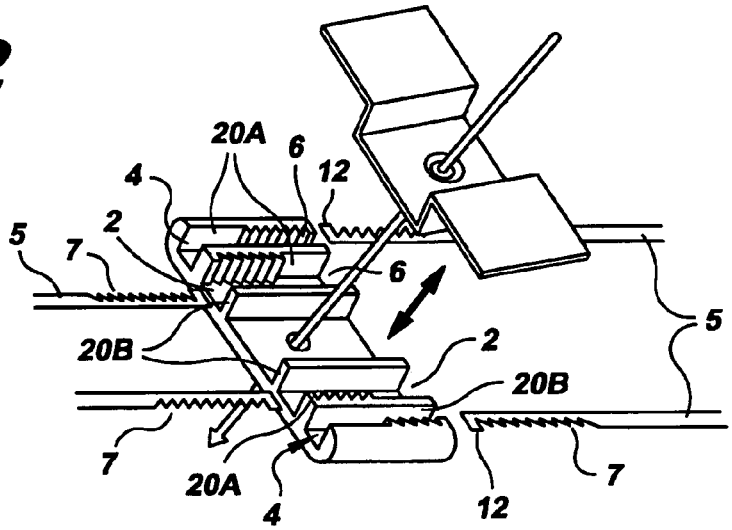
FIG. 2 is an interior view of the base plate.
Figure 3:
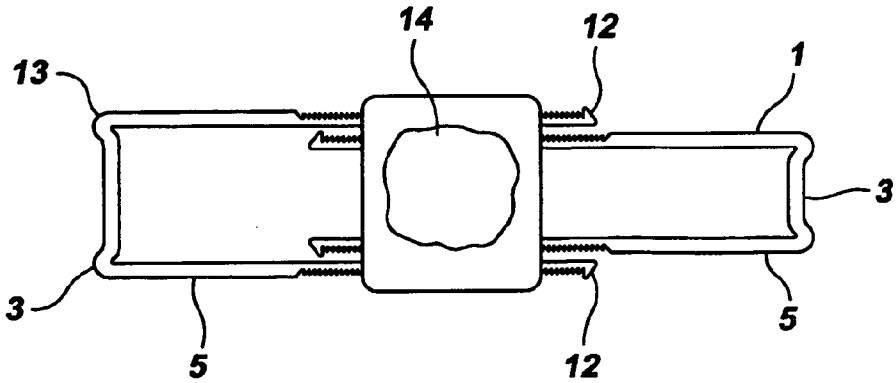
FIG. 3 is a top view of the device.
Figure 4:
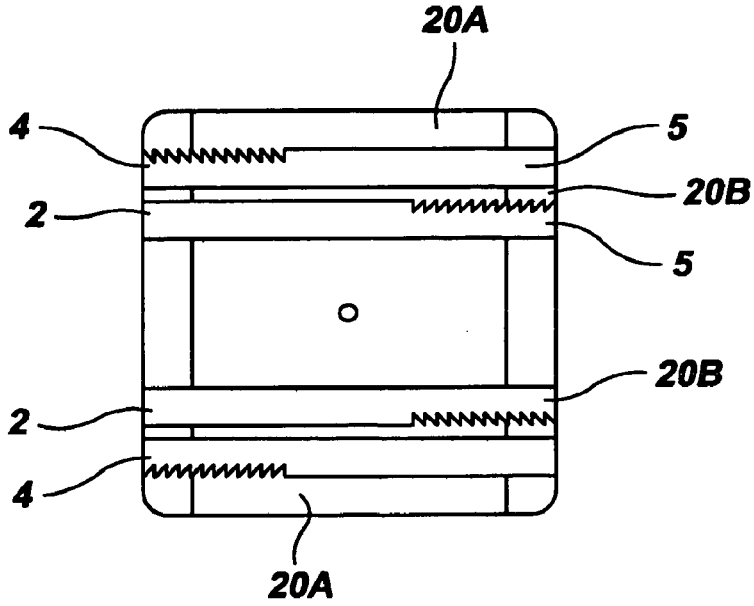
FIG. 4 is a detailed view of the base plate interior including the geared, channels.
Figure 5:
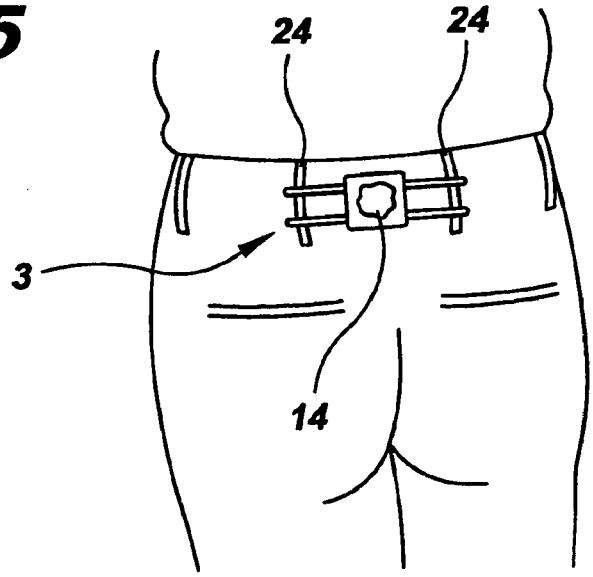
FIG. 5 depicts the device secured to a trouser.

The present invention relates to a device for securing a trouser 23 to a wearer. The device comprises a base plate 8 having an upper surface, a lower surface and two opposing open edges 31. Within the base plate are a pair of inner channels 2 and a pair of outer channels 4 all of which extend from one of the open edges to the other. Each channel is defined by a pair of spaced walls 20A, 20B. The outermost wall 20A of each channel includes a geared surface 6 along a portion thereof.

The device also includes a pair of belt loop clasps 1, 13 each including a hook portion 3 with a pair of spaced arms 5 integrally extending therefrom. Each arm includes a plurality of teeth 7 disposed along the length thereof for interlocking with the geared surface of a designated channel. A first clasp 1 extends from a first edge of the base plate with each arm slidably received within one of the inner channels; the other clasp 13 extends from the opposing edge of the base plate with each arm sliding within one of the outer channels. The gear teeth on each arm inter-engage the geared surface within its corresponding channel to selectively lock each clasp at a desired position. Preferably, each arm has a stop member 12 at its distal end to retain the arm within its designated channel. The device may also include an ornamental or decorative design element 14 on the top surface of the base plate.

To use the above described device, a user extends each clasp a predetermined distance from the base plate and secures each hook portion around a desired belt loop 24. For example, one clasp hook can be fastened to a belt loop immediately adjacent the trouser zipper while the second clasp hook can be fastened to the belt loop immediately adjacent the opposing side of the zipper. The user then presses each clasp into the base plate as far as possible, or until the trouser waist portion is sufficiently tight. When released, each clasp locks in place. To remove the device from the trouser, a user compresses a pair of arms on either of the clasps to disengage the teeth from the geared surface allowing the clasp to be freely extended from the base plate thereby releasing the device from the belt loops.

As depicted, the base plate can be formed of detachable components allowing a user to access the interior if necessary or desired. However, as will be readily apparent to those skilled in the art, the base plate can be unitary. The above described device is not to be limited to the exact details of construction and enumeration of parts set forth herein. Furthermore, the size, shape and materials of construction can be varied.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A device for securing trousers about a wearer's waist comprising:

a base plate having an upper surface, a lower surface and two opposing side edges;

a pair of inner channels extending from one of the side edges of the base plate to the other of said side edges, each channel including a geared surface therein;

a pair of outer channels extending from one of the side edges of the base plate to the other of said side edges, each channel including a geared surface therein;

a first belt loop clasp extending from one of said side edges for fastening to a first trouser belt loop, said first clasp including a pair of arms each having teeth disposed thereon, each of said arms of said first clasp received within one of the inner channels with said teeth inter-engaging the geared surface within said inner channel;

a second belt loop clasp extending from another of said side edges for fastening to a second trouser belt loop, said second clasp including a pair of arms each having teeth disposed thereon, each of said arms of said second clasp received within one of the outer channels with said teeth of said second clasp inter-engaging the geared surface within said outer channel thereby locking said arms of said first clasp within said inner channel and said arms of said second clasp within said outer channels, whereby compression of each of said arms disengages the teeth of said first clasp and said second clasp from the geared surfaces within said inner channel and said outer channel respectively allowing each of said arms to move freely therein.

2. The device according to claim 1 wherein each of said clasps further includes a hook portion for adhering to a trouser belt loop.

3. The device according to claim 1 further comprising a design element on the upper surface of said base plate.

4. The device according to claim 1 wherein each of said arms include a distal end with a stop member thereon for retaining said arms within said channels.

* * * * *